US006643485B2

(12) United States Patent
Takahara

(10) Patent No.: US 6,643,485 B2
(45) Date of Patent: Nov. 4, 2003

(54) ELECTROPHOTOGRAPHIC APPARATUS

(75) Inventor: Kenichi Takahara, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/955,085

(22) Filed: Sep. 19, 2001

(65) Prior Publication Data

US 2002/0037181 A1 Mar. 28, 2002

(30) Foreign Application Priority Data

Sep. 27, 2000 (JP) ..... P2000-295270

(51) Int. Cl.[7] ..... G03G 15/10; G03G 21/00
(52) U.S. Cl. ..... 399/250; 399/92
(58) Field of Search ..... 399/249, 250, 399/251, 92, 93

(56) References Cited

U.S. PATENT DOCUMENTS

| | | | | |
|---|---|---|---|---|
| 3,767,300 A | * | 10/1973 | Brown et al. | 399/250 |
| 5,420,675 A | * | 5/1995 | Thompson et al. | 399/237 |
| 5,737,674 A | | 4/1998 | Venkatesan et al. | |
| 6,064,851 A | * | 5/2000 | Saitoh | 399/249 |
| 6,178,304 B1 | * | 1/2001 | Sakai | 399/251 |
| 6,289,192 B1 | * | 9/2001 | Nukada et al. | 399/250 |
| 6,381,433 B1 | * | 4/2002 | Sakai | 399/250 |

FOREIGN PATENT DOCUMENTS

| | | | |
|---|---|---|---|
| JP | 8-190276 | * | 7/1996 |
| JP | 8-320619 | | 12/1996 |
| JP | 9-114254 | | 5/1997 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An electrophotographic apparatus having a development unit for forming a toner image by developing an electrostatic latent image formed at a surface of a latent image holding member by liquid developer, a drying unit for vaporizing a portion of liquid carrier included in the developer by supplying drying gas to the liquid developer at the surface of the latent image holding member, a heating unit for heating the toner image formed on the surface of the latent image holding member and a transfer unit for transferring the heated toner image from the surface of the latent image holding member to a recording medium, further including a cover for a gas flow path guiding the supplied drying gas to a heated area of the surface of the latent image holding member heated by the heating unit along the latent image holding member and having liquid carrier recovery unit for recovering the drying gas guided to the heating area thereby to prevent vapor of the liquid carrier produced at plural locations from leaking out and in a small-sized apparatus.

26 Claims, 6 Drawing Sheets

ELECTROPHOTOGRAPHIC APPARATUS

CROSS-REFERENCE TO RELATED APPLICATION

This application is based upon and claims the benefit of priority from the prior Japanese Patent Application No. 2000-295270, filed Sep. 29, 2000, the entire contents of which are incorporated herein by reference.

BACKGROUND OF THE INVENTION

The present invention relates to an electrophotographic apparatus, particularly to an electrophotographic apparatus using liquid developer.

A liquid electrophotographic apparatus using liquid developer dispersing toner particles in liquid carrier, is provided with an advantage which cannot be realized by a dry process electrophotographic apparatus.

A liquid electrophotographic apparatus is provided with following advantages in comparison with a dry process electrophotographic apparatus.

1. High picture quality can be realized since an extremely fine toner particles of sub micron size can be used.
2. A sufficient picture density is provided by a small amount of toner particles and therefore, the apparatus is economical and can realize texture comparable to that in printing (for example, offset printing).
3. Toner particles can be fixed to paper at comparatively low temperature and therefore, energy conservation and high-speed output can be realized.

Meanwhile, according to the conventional electrophotographic technology using liquid developer, there are several problems. One of the problems is caused by using liquid carrier for dispersing toner particles. That is, a petroleum species liquid is normally used for the liquid carrier and therefore, there is a concern of contaminating the environment.

There are disclosed electrophotographic apparatus that contain improvements in regard to the problem of contaminating the environment, for example, Japanese Patent Laid-Open No. 320619/1996 and Japanese Patent Laid-Open No. 114254/1997.

According to the electrophotographic apparatus, there is adopted a system of transferring a toner image formed on a surface of a photosensitive roller onto paper by electrophoresis in a state in which liquid carrier is present on the surface of the photosensitive roller. Further, the paper with the toner image transferred is carried to a fuser and the toner image is fixed onto the paper by heat fixing. At this moment, the liquid carrier absorbed in the paper is evaporated by heat in heat fixing.

The electrophotographic apparatus is provided with liquid carrier absorbing chamber for covering the fuser. The vapors of the liquid carrier produced by the fuser is sucked by the liquid carrier absorbing chamber and recovered to thereby prevent the vapors from leaking to outside of a cabinet of the liquid electrophotographic apparatus.

Further, according to Japanese Patent Publication No. 17950/1983, a fixing and drying chamber having a paper discharge port is constituted by an airtight structure as much as possible and the inside of the fixing and drying chamber is maintained under negative pressure to thereby prevent a vapor of the liquid carrier from leaking from a gap of the fixing and drying chamber.

That is, conventional technology of preventing leakage of liquid carrier is executed with regard to liquid carrier adhered to paper.

Meanwhile, researches are carried out on technology of providing an image having a higher accuracy by reducing disturbance of the image transfer by transferring a toner image from a photosensitive roller to a recording medium by utilizing adhering force of toner particles.

According to the system, for example, after evaporating almost all of liquid carrier present at a surrounding of a toner image formed on a surface of a photosensitive roller by blowing drying gas, the toner image is transferred to an intermediate transfer roller arranged to be in contact with the photosensitive roller, further, the toner image is transferred from the intermediate transfer roller to paper by bringing the toner image in contact therewith. At this occasion, viscoelasticity is provided to toner particles for forming the toner image by heating the intermediate transfer roller.

According to the system, the vapor of the liquid carrier is produced at two locations of the surface of the photosensitive roller blown with the drying gas and at the surface of the heated intermediate transfer roller.

A method of recovering the vapor of the transfer system utilizing adhering force of toner particles, that is, the liquid electrophotographic apparatus producing the vapor at plural locations, has not yet been investigated sufficiently and, for example, when mechanisms of recovering the vapor are arranged at respective locations of producing the vapor, there is a problem that the liquid electrophotographic apparatus is becoming large-sized.

BRIEF SUMMARY OF THE INVENTION

An object of the present invention is to provide an electrophotographic apparatus which prevents vapor of the liquid carrier produced inside of a cabinet from leaking to outside of the cabinet.

According to a first aspect of the present invention, there is provided an electrophotograpic apparatus using liquid developer comprising: a latent image holding member to form an electrostatic latent image on a surface of the latent image holding member; a development unit which develops the electrostatic latent image by the liquid developer containing liquid carrier and toner particles, and forms a toner image on the surface of the latent image holding member; a gas supply unit which supplies gas to evaporate a part of the liquid carrier and generates a vapor of the liquid carrier; a heater which heats a region in which the toner image is formed; an image transfer unit which transfers the toner image from the latent image holding member to a recording medium; a cover which covers the latent image holding member, and leads the gas with the vapor of the liquid carrier to the region; a recovery system which collects the gas with the vapor of the liquid carrier in the region.

According to a second aspect of the present invention, there is provided an electrophotograpic apparatus using liquid developer comprising: a latent image holding member to form an electrostatic latent image on a surface of the latent image holding member; a development unit which develops the electrostatic latent image by the liquid developer containing liquid carrier and toner particles, and forms a toner image on the surface of the latent image holding member; a gas supply unit which supplies gas to evaporate a part of the liquid carrier and generate a vapor of the liquid carrier; an intermediate transfer body which transfers the toner image from the latent image holding member to a recording medium and heats the region in which the toner image is formed; a cover which covers the latent image holding member, and leads the gas with the vapor of the liquid carrier to the region; a recovery system which collects the gas with the vapor of the liquid carrier in the region.

DETAILED DESCRIPTION OF THE INVENTION

An explanation will be given of a first embodiment of this invention in reference to the drawings.

Figure 1:
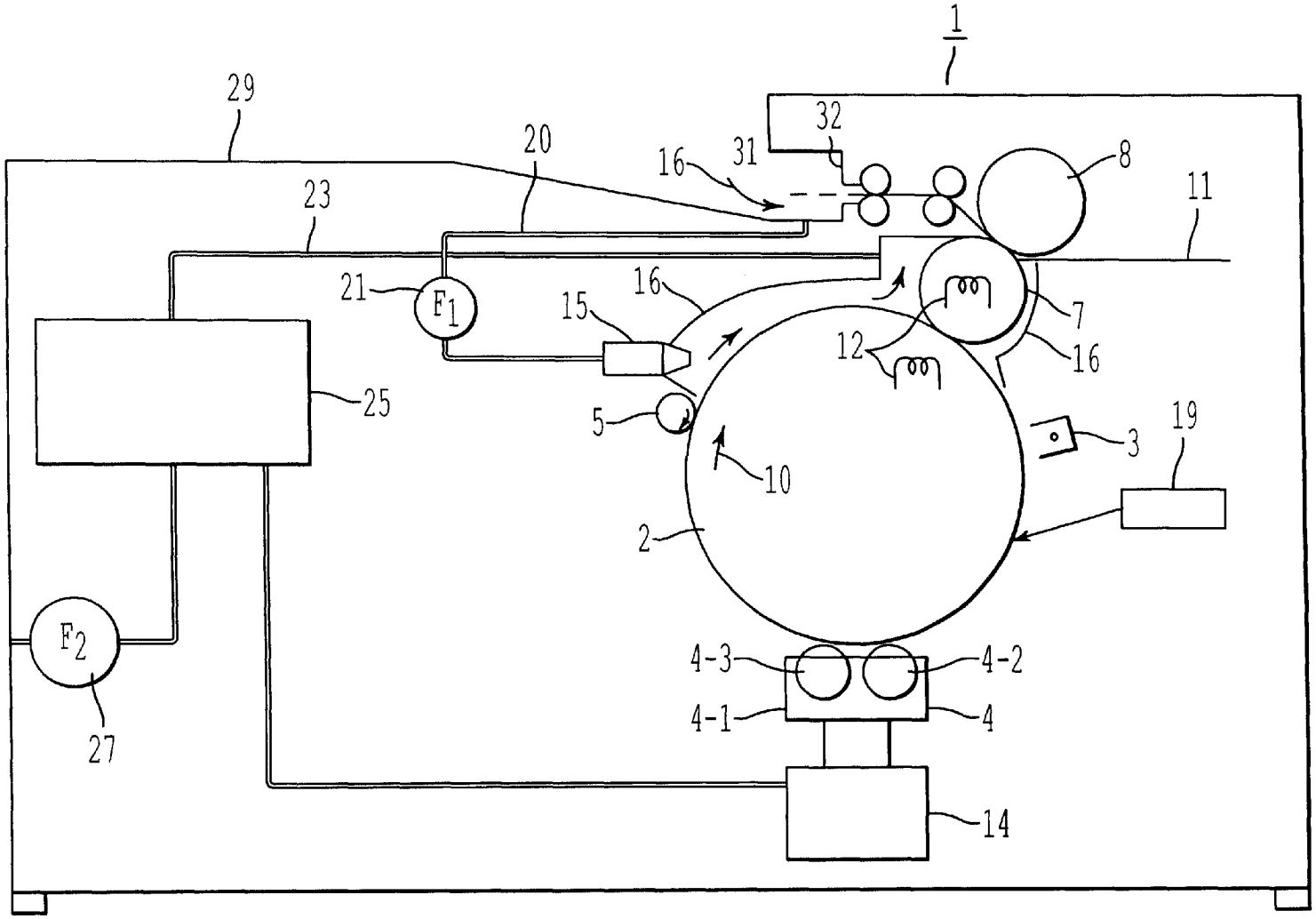
FIG. 1 is an outline constitution view of an electrophotographic apparatus showing a first embodiment of this invention.

FIG. 1 is an outline constitution view of a liquid electrophotographic apparatus using liquid developer showing the first embodiment of this invention.

First, an explanation will be given of an image forming process.

A liquid electrophotographic apparatus 1 comprises a cabinet 29. Inside of the cabinet 29, there is arranged a latent image holding member comprising a photosensitive roller 2 rotated in a direction designated by an arrow mark 10.

A charger 3 is arranged at a surrounding of the photosensitive roller 2 and the charger 3 uniformly charges the surface of the photosensitive roller.

The charged photosensitive roller 2 is rotated in the arrow mark 10 direction and the surface is selectively exposed by a light source such as a laser oscillator 19. A charge amount of the surface of the photosensitive roller 2 is selectively attenuated only at an exposed area. As a result, there is formed an electrostatic latent image comprising charged areas (nonexposed areas) and noncharged areas (exposed areas).

The electrostatic latent image is successively developed by a development unit 4. The development unit 4 includes a vessel 4-1 for containing liquid developer and a development electrode 4-2 in, for example, roller-like shape arranged proximately to the photosensitive roller 2.

Further, the liquid developer includes toner particles and liquid carrier dispersedly holding the toner particles. The liquid developer is adjusted in a desired concentration and contained in a liquid developer tank 14. The liquid developer is circulated between the liquid developer tank 14 and the vessel 4-1.

The liquid developer supplied from the liquid developer tank 14 to the vessel 4-1 is carried by being adhered to the development electrode 4-2 in the rotating roller-like shape and is brought into contact with the photosensitive roller 2. In the liquid developer supplied to the photosensitive roller 2, the toner particles in the liquid developer is selectively adhered to the charged area or the noncharged area of the photosensitive roller 2 by electrophoresis in accordance with an electric field between the photosensitive roller 2 and the development electrode. As a result, there is formed a toner image based on the electrostatic latent image which has been developed by the toner particles on the charged photosensitive roller 2.

Further, as liquid carrier, there is used a liquid which is nonpolar and having excellent performance of dispersing the toner particles and normally, a petroleum species solvent such as Isoper (made by Exon Chemical Corporation) is used. Further, a mixture of resin and pigment is used for the toner particles.

Further, according to the electrophotographic apparatus shown in FIG. 1, there is arranged a squeeze roller 4-3 arranged proximately to the photosensitive roller 2. The squeeze roller 4-3 is rotated to move in a direction opposed to that of the photosensitive roller 2 at an opposed portion thereof to thereby squeeze off the liquid carrier physically. Further, by supplying the squeeze roller 4-3 with predetermined potential, after development by the development electrode 4-2, the toner particles remaining at the noncharged area of the surface of the photosensitive roller 2 can also be removed from the surface of the photosensitive roller 2.

The toner image on the surface of the photosensitive roller 2 formed by the liquid developer in this way, is transferred to an intermediate transfer roller 7. For example, transfer of the toner image from the photosensitive roller 2 to the intermediate transfer roller can be carried out by utilizing the adhering force of the toner particles. In this case, the transfer efficiency can be promoted by bringing about a state in which there remains the liquid carrier of a small amount to a degree of not solidifying toner particles at a periphery of the toner particles for forming the toner image.

For that purpose, the liquid carrier on the surface of the photosensitive roller 2 is further removed on the downstream side of the development unit 4 and on the upstream side of the intermediate transfer roller 7. For example, the liquid carrier is removed by an absorbing roller 5 or a blowing nozzle 15. The absorbing roller 5 is formed by a porous material such as sponge and is arranged to be brought into contact with the photosensitive roller 2. The liquid carrier on the surface of the photosensitive roller 2 is brought into contact with the absorbing roller 5 and absorbed thereby. The blowing nozzle 15 vaporizes the liquid carrier by blowing drying gas supplied from a wind blowing apparatus to the liquid developer on the surface of the photosensitive roller 2 and removes the liquid carrier to a degree by which there remains a small amount of the liquid carrier to a degree of not solidifying the toner particles.

The drying gas used here can be used without being particularly limited, for example, air or the like can be used. Particularly, the liquid carrier can further be expedited to dry by using dried gas or gas at temperature higher than room temperature.

Here, the liquid carrier is removed by using two kinds of the absorbing roller 5 and the blowing nozzle 15 because it is difficult to sufficiently remove the liquid carrier by only using the absorbing roller 5 and when the liquid carrier is removed only by the blowing nozzle 15, a long period of time is needed for removing the liquid carrier.

In a state in which almost all of the liquid carrier has been removed in this way, a toner image on the surface of the photosensitive roller 2 is transferred to an intermediate transfer medium such as the intermediate transfer roller 7.

The intermediate transfer roller 7 includes a rigid roller and an elastic layer formed on the surface of the rigid roller and is arranged to be brought into press contact with the photosensitive roller 2. Further, the elastic layer is subjected to a surface treatment such that a performance of the surface of the photosensitive roller 2 for removing the toner particles becomes higher than a performance of the surface of the elastic layer for removing the toner particles.

The toner image carried to the portion of bringing the photosensitive roller 2 and the intermediate transfer roller 7 into press contact with each other, is exfoliated from the photosensitive roller 2 by the adhering force of the toner particles and is primarily transferred to the intermediate transfer roller 7.

Further, a heater 12 is arranged at inside of the intermediate transfer roller 7 for heating the surface of the intermediate transfer roller 7 and vicinity thereof. There are two objects for heating the surface of the intermediate transfer roller 7. One of the objects is to provide viscoelasticity to the toner particles for forming the toner image. This is for promoting the transfer efficiency for transferring the toner particles from the photosensitive roller 2 and the intermediate transfer roller 7 to an intermediate transfer roller. Other of the objects is to vaporize the liquid carrier remaining in the toner image on the surface of the intermediate transfer roller 7. When the liquid carrier is included in the toner image on the surface of the intermediate transfer roller 7, the liquid carrier permeates also into the toner image transferred on paper 11, as a result, the liquid carrier is discharged outside of the cabinet 29 along with the paper 11. Therefore, by heating the intermediate transfer roller and vaporizing the liquid carrier included in the toner image at inside of the cabinet, the carrier can be prevented from discharging outside of the cabinet 29 by way of the paper 11.

The heater 12 for heating the intermediate transfer roller 7 may be arranged to the intermediate transfer roller or may be arranged at inside of the photosensitive roller 2.

A press-roller 8 is brought into press contact with the intermediate transfer roller 7 and the press contact portion is supplied with a recording medium such as the paper 11. The toner image transferred to the intermediate transfer roller 7 is brought into contact with the paper 11 and is secondarily transferred from the intermediate transfer roller 7 to the paper 11 by the adhering force of the toner particles.

In this way, after transferring the toner image from the photosensitive roller 2 to the recording medium by a transfer apparatus having the intermediate transfer roller 7 and the backup roller 8, the toner particles remaining on the surface of the photosensitive roller without having been transferred, is removed from the surface of the photosensitive roller 2 by a cleaner (not illustrated) and a successive image forming process is carried out by the photosensitive roller.

Next, an explanation will be given of flow of the drying gas supplied into the cabinet 29.

According to the electrophotographic apparatus 1 shown in FIG. 1, the drying gas (air) is sucked from a suction port provided at a vicinity of a discharge port 32 of the paper 11 by a pump (or fan) 21 and the sucked air is blown to the photosensitive roller 2.

Further, a port of the apparatus from the surface of the photosensitive roller 2 supplied with the drying gas over to the intermediate transfer roller 7, is covered by a cover 16 formed along the surface of the photosensitive roller 2 and forms a space formed as hermetically as possible by the photosensitive roller 2 and the cover 16. The drying gas blown from the blowing nozzle 15 is guided to the heated intermediate transfer roller 7 along the cover 16.

Although it is inherently preferable that the space closed as hermetically as possible, constitutes a completely hermetically closed space by the cover 16 and the photosensitive roller 2, it is permitted that at a vicinity of an area where the intermediate transfer roller 7 and the paper 11 are brought into contact with each other and at a vicinity of the surface of the photosensitive roller 2, gaps are provided between the vicinities and the cover 16. The reason is that it is difficult to set an interval between the rotatable sensitive roller 2 and the fixed cover 16 into a completely hermetically closed state. Further, because it is necessary to bring the intermediate transfer roller 7 into contact with the paper 11 transferred to outside of the cabinet 29 and accordingly, a gap is needed at the vicinity of the area for bringing the intermediate transfer roller into contact with the paper 11.

That is, the cover 16 is constructed by a structure in which the cover 16 is arranged proximately to surface of the photosensitive roller 2 and the region of transferring the toner particles to the paper 11 and at other area, gas is not moved to outside of the cover 16.

By constructing such a structure, the drying gas and the liquid carrier can be brought into contact with each other for a long period of time during a time period from the region blown with the drying gas from the blowing nozzle 15 and the region arranged with the intermediate transfer roller 7. And accordingly, the efficiency of drying the toner image relative to the flow rate of the drying gas can be promoted.

At a vicinity of the intermediate transfer roller 7 of the cover 16, there is connected liquid carrier recovery path 23 for recovering gas at inside of the space closed as hermetically as possible covered by the cover by, for example, a suction pump (or fan) 27. That is, gas including drying gas, vapor of the liquid carrier vaporized by being dried and vapor of the liquid carrier vaporized by being heated at the transfer apparatus such as the intermediate transfer roller 7, is recovered from the liquid carrier recovery path 23 to liquid carrier recovery apparatus 25 (however, the liquid carrier recovery path 23 is not connected to a pipe 20 connected to the pump 21).

The liquid carrier recovery apparatus 25 is arranged with a cooling apparatus of, for example, a Peltier element. Gas recovered into the liquid carrier recovery apparatus 25 is cooled by cooling means for liquefying the vapor of the liquid carrier in the gas. Further, the liquefied liquid carrier is removed and recovered to, for example, the vessel 14 and gas removed of the vapor is discharged to outside of the cabinet 29 by the pump 27 (fan) for recovery.

In this way, by providing the cover 16, vapor of the liquid carrier produced by the heater 12 and the drying gas can be recovered by a single one of the pump 27 for recovery.

Further, when gas flow amounts of the pumps 21 and 27 are respectively designated by notations F1 and F2, it is preferable that $F1<F2$.

In the case of $F1 \geqq F2$, there is a concern that the gas is leaked from the gap of the cover 16 in the space closed as hermetically as possible formed by the cover 16 and the photosensitive roller 2, for example, at the vicinity of the area where the intermediate transfer roller 7 and the paper 11 are brought into contact with each other, into the cabinet 29, depending on cases, further to outside of the cabinet 29.

According to the liquid electrophotographic apparatus having such a constitution, whereas when recovery of the vapor produced by, for example, drying gas and recovery of the vapor produced by heating the intermediate transfer roller 7, are carried out separately, two pumps (or fans) are needed, the vapor produced from two locations can be recovered by the single pump 27 (or fan). And accordingly, the liquid electrophotographic apparatus can be downsized.

Figure 2:
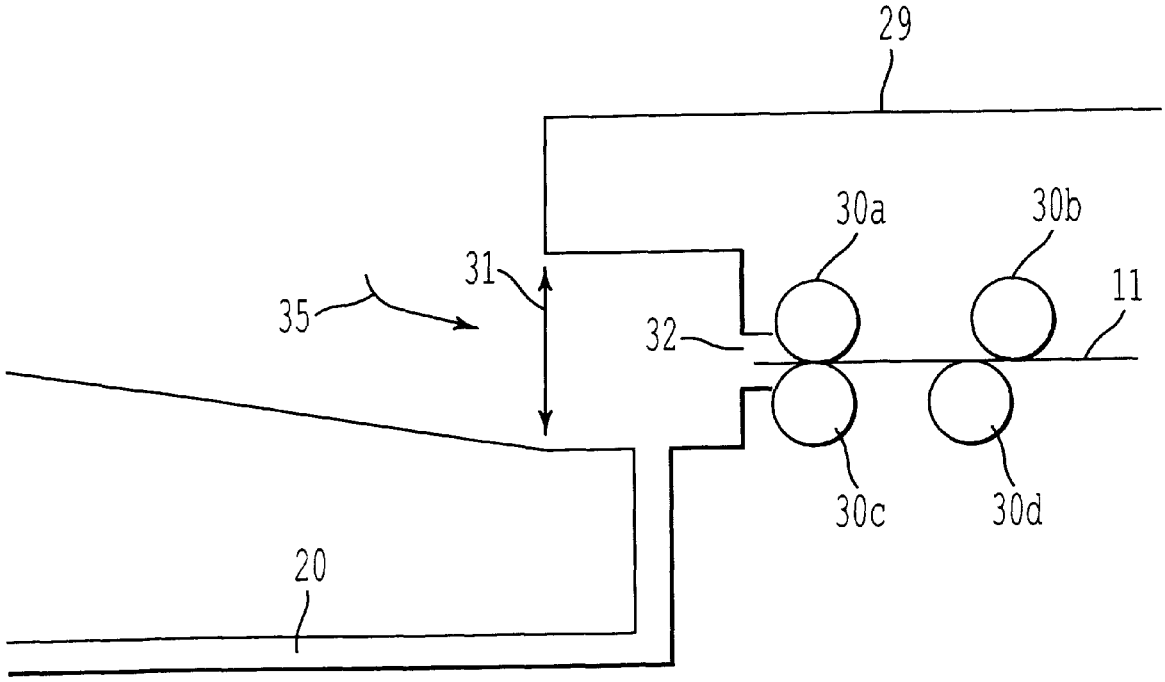
FIG. 2 is an enlarged partial view of a vicinity of a paper discharge port of the electrophotographic apparatus.

FIG. 2 is an enlarged partial view of a paper discharge port of the electrophotographic apparatus shown in FIG. 1.

After the toner image has been transferred, the paper 11 is feeded by four carrier rollers 30*a*, 30*b*, 30*c* and 30*d* and discharged from the paper discharge port 32.

The paper discharge port 32 is provided at a recess port formed in the cabinet 29. The recess port is connected with one end of the introducing pipe 20 connected to the blowing nozzle and formed with the suction port of the drying gas delivered to the blowing nozzle.

As a result, an air flow 35 designated by an arrow mark is formed at a vicinity of the suction port 31 and accordingly, even when the vapor is leaked from the discharge port 32, the vapor is carried from the suction port into the cabinet 29.

By reducing an aperture 31 of the recess port formed in the cabinet 29, the air flow 35 at the aperture 31 can be increased and therefore, the vapor can further be reduced from leaking to outside of the recess port.

Figure 3:
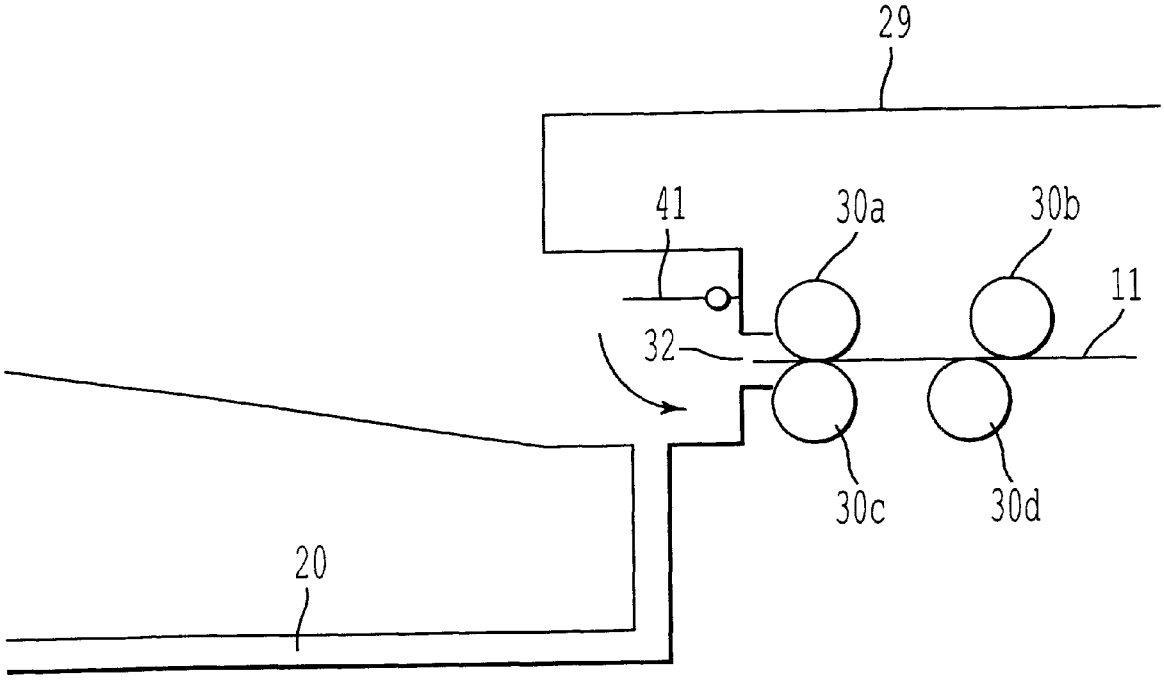
FIG. 3 is an enlarged partial view showing a first modified example of the vicinity of the paper discharge port of the electrophotographic apparatus.

FIG. 3 is an enlarged view showing a first modified example of the vicinity of the paper discharge port.

In FIG. 3, there is arranged a paper discharge port lid 41 having a rotating shaft 40 at the paper discharge port 32. The paper discharge port 41 is brought into a state of opening the paper discharge port 32 as illustrated at least during a time period in which the paper passes through the paper discharge port and during a time period in which the paper does not pass through the discharge port 31 as in a time period in which power supply of the image forming apparatus is made OFF, the paper discharge port 41 is moved in an arrow mark 42 direction in the drawing centering on the rotating shaft 40 and closes the paper discharge port 32. As a result, during the time period in which the power supply is made OFF, airtightness of the inside of the cabinet 29 can be maintained and the vapor is prevented from leaking from the cabinet 29 to thereby realize the safe and clean electrophotographic apparatus without contaminating environment.

Further, by mounting a lid similar to the paper discharge port 41 to an outer side of the cabinet 29 of the discharge pipe 26 of FIG. 1, the liquid carrier can be prevented from leaking out when the power supply is made OFF.

Figure 4A:
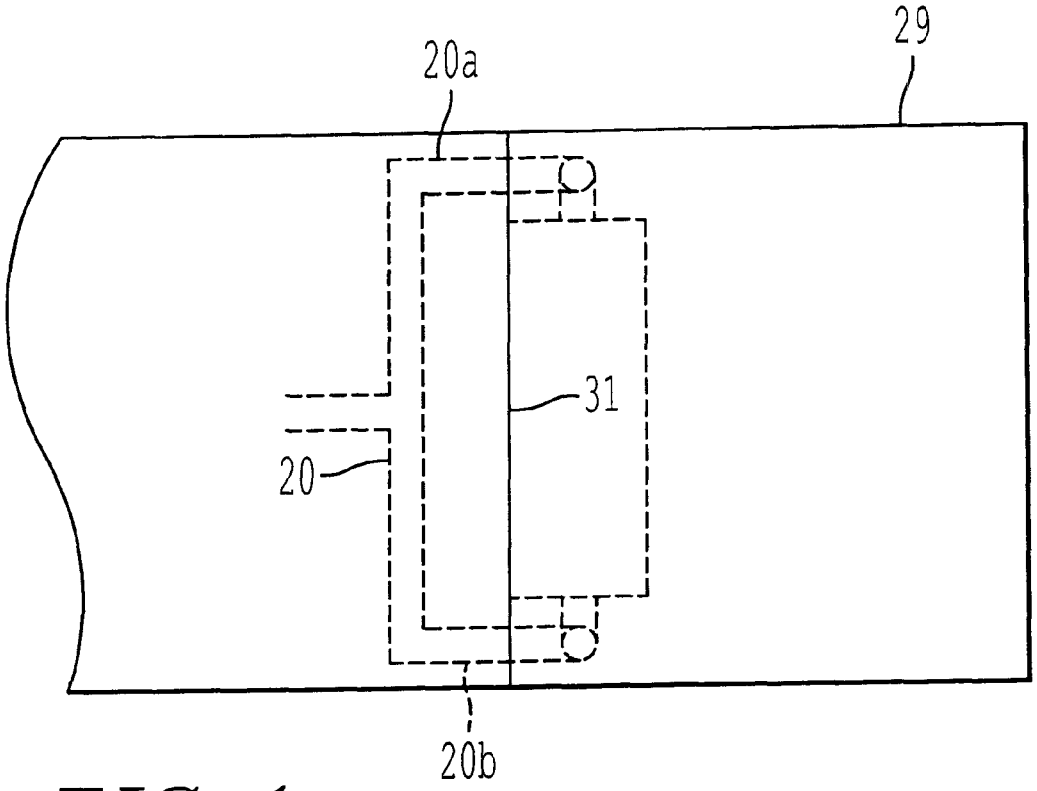
FIGS. 4A and 4B are enlarged partial views showing a second modified example of the vicinity of the paper discharge port of the electrophotographic apparatus.
Figure 4B:
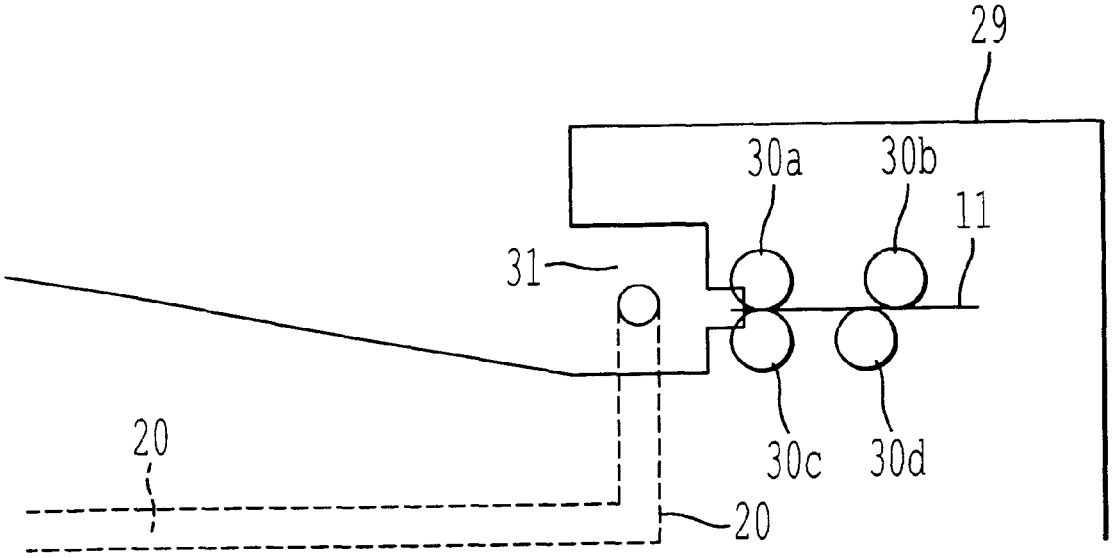

FIGS. 4A and 4B are enlarged views showing a second modified example of the vicinity of the paper discharge port in which FIG. 4A is a plane view viewed from an upper face and FIG. 4B is a sectional view viewed from a side face.

According to the modified example, one end of the introducing pipe 20 connected to the blowing nozzle is bifurcated and bifurcated introducing pipes 20*a* and 20*b* are constituted on both sides of the recess port 31 of the cabinet 29 as illustrated.

According to the electrophotographic apparatus having such a constitution, the suction ports are formed at side faces of the recess port 31 and accordingly, the suction ports are not closed by the discharged paper 11. Further, since the suction ports are arranged on the both sides of the recess port, left and right suction force operated to the discharged paper 11 become uniform and the paper 11 can stably be discharged. As a result, jamming in discharging the paper can be prevented and the electrophotographic apparatus having high reliability can be provided. Although the suction port is made circular in the drawing, according to the invention, the effect can be achieved without depending on the shape of the suction port. Further, although the suction ports are provided on the left and on the right of the paper discharge chamber, a similar effect can be achieved by providing the suction ports at the upper side and the lower side of the paper discharge port.

Figure 5:
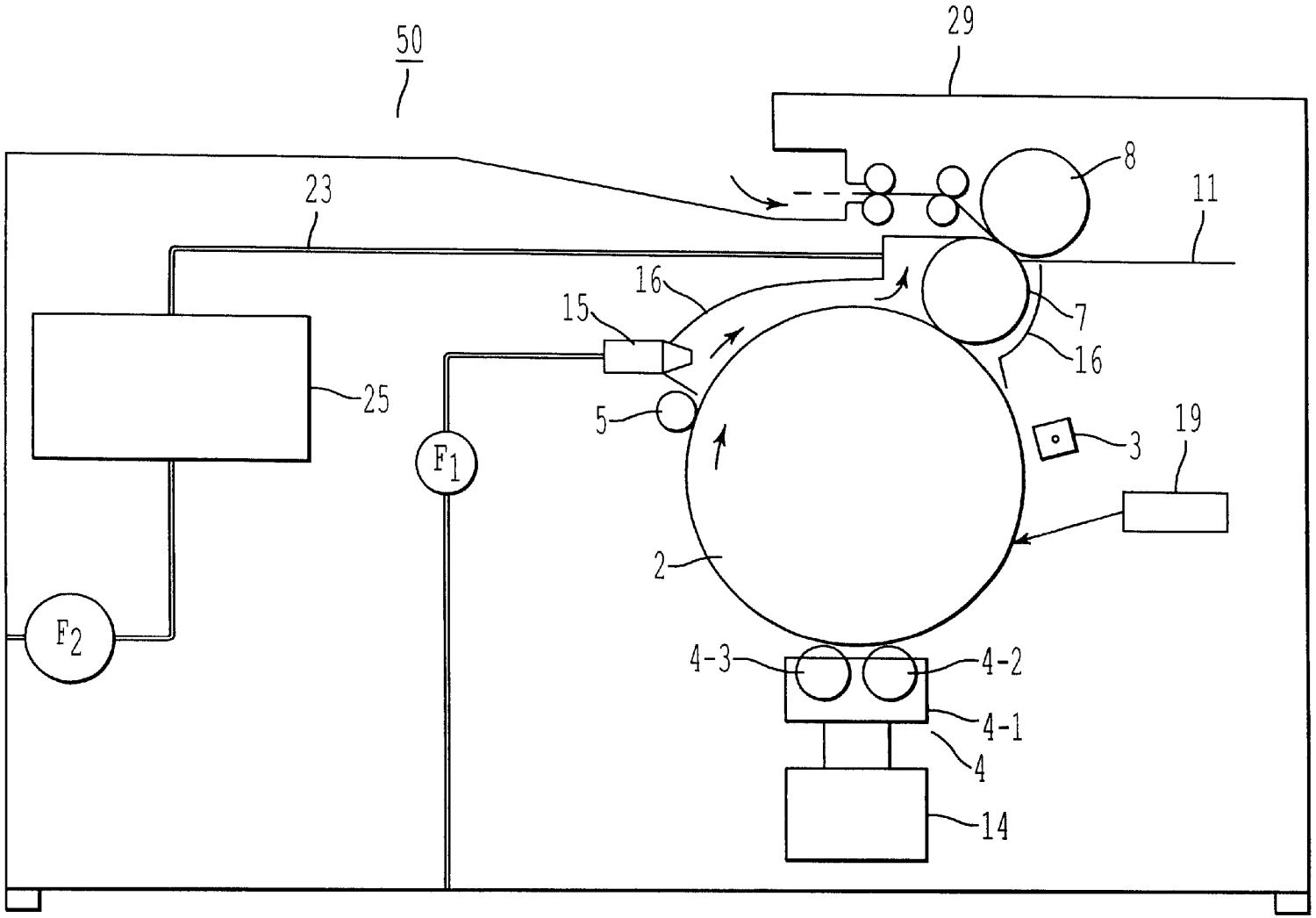
FIG. 5 is an outline constitution view of an electrophotographic apparatus showing a second embodiment of this invention.

FIG. 5 is a view showing a second embodiment of an electrophotographic apparatus according to the invention. According to the electrophotographic apparatus, one end of the introducing pipe 20 connected to the blowing nozzle 15 is provided at a bottom portion of the cabinet 29. In the drawing, portions the same as those in FIG. 1 are attached with the same notations and a detailed explanation thereof will be omitted.

A liquid electrophotographic apparatus 50 is provided with the suction port of the introducing pipe 20 not at the vicinity of the paper discharge port but at the bottom portion of the machine. According to the liquid electrophotographic apparatus 50, the air intake port is disposed at the bottom portion of the machine and therefore, noise by sucking can be reduced.

Figure 6:
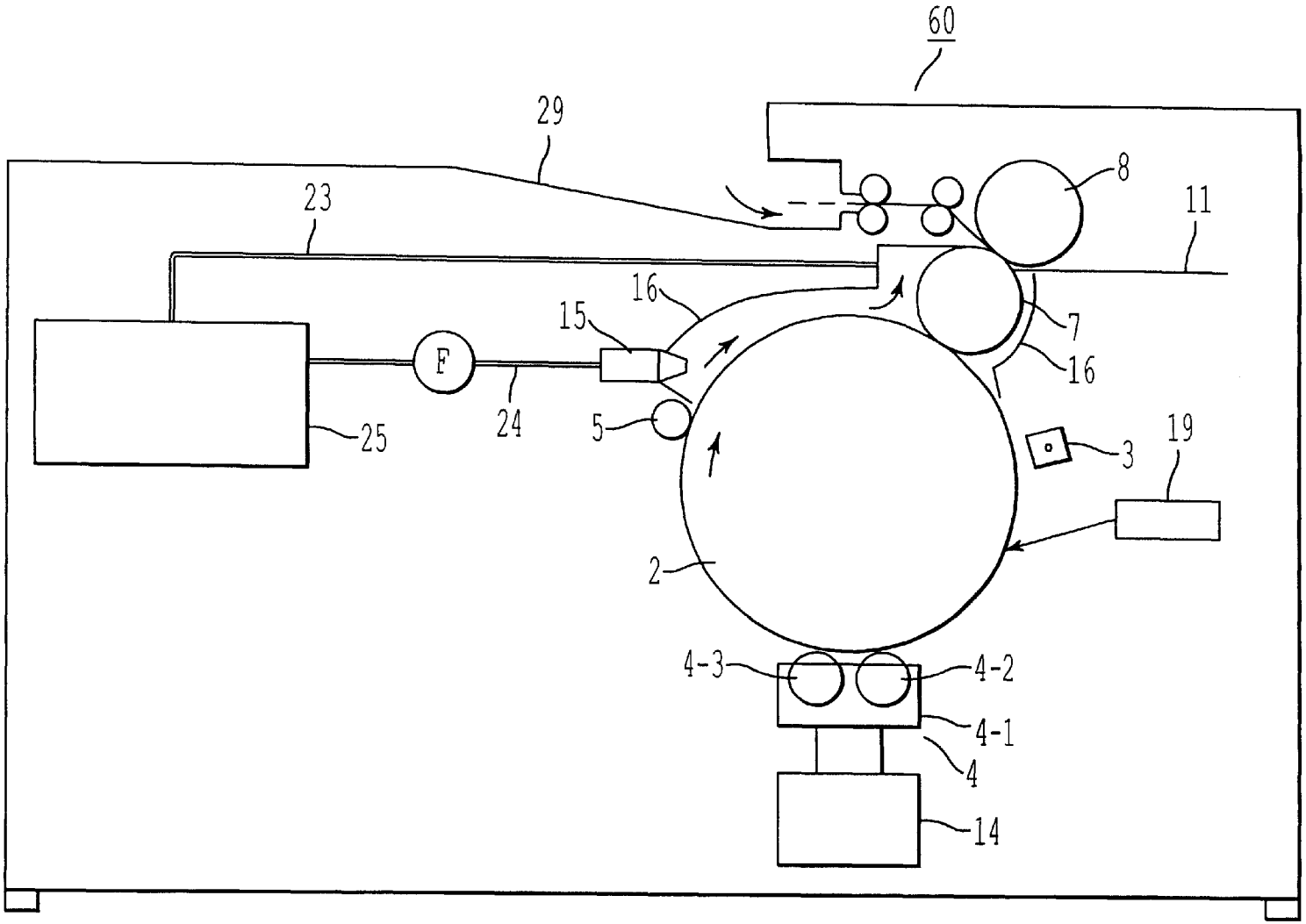
FIG. 6 is an outline constitution view of an electrophotographic apparatus showing a third embodiment of this invention.

FIG. 6 is a view showing a third embodiment of an electrophotographic apparatus according to the invention (the same notations designate port the same as those in FIG. 1 and an explanation thereof will be omitted).

An electrophotographic apparatus 60 shown in FIG. 6 differs from the liquid electrophotographic apparatus shown by FIG. 1 in that the drying gas is used to circulate the blowing nozzle 15, the surface of the photosensitive member, the liquid carrier recovery apparatus and the blowing nozzle 15. That is, the blowing nozzle 15 and the liquid carrier recovery apparatus 25 are connected by a pipe 24 and the drying gas removed of the liquid carrier component is discharged from the blowing nozzle again.

According to the electrophotographic apparatus shown in FIG. 1, the drying gas processed by the liquid carrier recovery apparatus 25 is discharged to outside of the cabinet 29. Therefore, it is necessary to use the liquid carrier recovery apparatus capable of liquefying a large amount of the liquid carrier in a short period of time to prepare for the case in which vapor of the liquid carrier is produced by a large amount as in the case of carrying out the image forming process continuously. As a result, large-sized formation of the carrier solution recovery apparatus 25 results.

According to the electrophotographic apparatus shown in FIG. 6, the drying gas repeatedly passes through the liquid carrier recovery apparatus 25 and accordingly, even when the image forming process has been finished, by starting the liquid carrier recovery apparatus, even in the case in which liquefying capability of the liquid carrier recovery apparatus 25 is comparatively low, the vapor of the liquid carrier filled in the cover 16 can firmly be liquefied by taking a long period of time. As a result, the liquid carrier recovery apparatus can be downsized.

Further, the pump for supplying the drying gas to the blowing nozzle and the pump for sucking the drying gas and the vapor of the liquid carrier at inside of the cover 16 to the liquid carrier recovery apparatus, can commonly be used and therefore, the apparatus can be downsized in comparison with the electrophotographic apparatus shown in FIG. 1.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electrophotograpic apparatus using liquid developer comprising:

a latent image holding member to form an electrostatic latent image on a surface of the latent image holding member;

a development unit which develops the electrostatic latent image with the liquid developer containing liquid carrier and toner particles, and forms a toner image on the surface of the latent image holding member;

a gas supply unit which supplies gas to evaporate a part of the liquid carrier and generate a vapor of the liquid carrier;

an image transfer unit which transfers the toner image from the latent image holding member to a recording medium;

a cover which covers a part of the image transfer unit and a part of the latent image holding member;

a heater which heats the toner image on the image holding member or the toner image on the image transfer unit in a region bordered by the cover; and a recovery system which collects the gas with the vapor of the liquid carrier from the region, wherein the gas supply unit supplies the gas to the region through a first portion of the cover, and the recovery system collects the gas with the vapor of the liquid carrier from the region through a second portion of the cover close to the heated area by the heater.

2. An electrophotograpic apparatus according to claim 1, wherein the recovery system comprises a liquefaction unit which liquefies the vapor of the liquid carrier, and separates the gas and the liquid carrier.

3. An electrophotographic apparatus according to claim 1, further comprising:

a circulation system which circulates the gas between the gas supply unit and the recovery system.

4. An electrophotographic apparatus according to claim 1, wherein the image transfer unit comprises:

an intermediate transfer body which is pressed against the latent image holding member, and a press-roller which is pressed against the intermediate transfer body through the recording medium.

5. An electrophotographic apparatus according to claim 4, wherein the intermediate transfer body comprises:

a rigid roller, and an elastic layer formed on a surface of the rigid roller.

6. An electrophotographic apparatus according to claim 1, further comprising:

a cabinet covering the development unit, the gas supply unit, the image transfer unit, the cover and the recovery system, wherein the cabinet has a hollow portion which has a discharge port to discharge the recording medium and a suction port to suck the gas which is supplied to the gas supply unit.

7. An electrophotographic apparatus according to claim 6, wherein:

the hollow portion has two suction ports which are faced each other, and the recording medium is discharged between two suction ports.

8. An electrophotographic apparatus according to claim 6, further comprising:

a link attached to the discharge port, wherein the link closes the discharge port when a power supply is turned off.

9. An electrophotographic apparatus using the liquid developer according to claim 6, wherein the suction port is disposed at the bottom of the cover.

10. An electrophotographic apparatus according to claim 1, further comprising:

a squeeze roller which squeezes a part of the liquid carrier on the latent image holding member before the liquid carrier is evaporated by the gas.

11. An electrophotographic apparatus according to the claim 1, further comprising:

an absorbing roller which absorbs a part of the liquid carrier on the latent image holding member before the liquid carrier is evaporated by the gas; and a squeeze roller which squeezes a part of the liquid carrier on the latent image holding member before the liquid carrier is absorbed by the absorbing roller.

12. An electrophotographic according to claim 1, wherein the gas supply unit comprises a first pump.

13. An electrophotographic according to claim 12, wherein the recovery system comprises a second pump.

14. An electrophotographic according to claim 13, wherein the flow of the first pump is smaller than the flow of the second pump.

15. An electrophotographic according to claim 1, wherein the heater is disposed inside the latent image holding member.

16. An electrophotographic apparatus according to claim 1, wherein the heater is disposed inside the image transfer unit.

17. An electrophotographic apparatus according to claim 1, wherein the development unit forms the toner image on the surface of the latent image holding member by electrophoresis.

18. An electrophotographic apparatus according to claim 1, wherein the region formed by the cover in said part of the latent image holding member is bordered further by a part of the image transfer unit.

19. An electrophotographic apparatus according to claim 1, wherein the recovery system and the gas unit are mutually connected.

20. An electrophotographic apparatus using liquid developer comprising:

a latent image holding member to form an electrostatic latent image on a surface of the latent image holding member;

a development unit which develops the electrostatic latent image with the liquid developer containing liquid carrier and toner particles, and forms a toner image on the surface of the latent image holding member;

a gas supply unit which supplies gas to evaporate a part of the liquid carrier and generates a vapor of the liquid carrier;

an intermediate transfer body which transfers the toner image from the latent image holding member to a recording medium and heats the region in which the toner image is formed;

a cover which encloses a region bordered by the cover, a part of the intermediate transfer body, and a part of the latent image holding member; and a recovery system which collects the gas with the vapor of the liquid carrier from the region, wherein the cover leads the gas with the vapor of the liquid carrier to a part of the region connected with the recovery system, and wherein heating the intermediate transfer body and evaporating the liquid carrier prevent a discharge of the liquid carrier outside said electrophotographic apparatus.

21. An electrophotograpic apparatus according to claim 20, wherein the recovery system comprises:

a liquefaction unit which liquefies the vapor of the liquid carrier, and thereby separates the gas and the liquid carrier.

22. An electrophotographic apparatus according to claim 20, further comprising:

a circulation system which circulates the gas between the gas supply unit and the recovery system.

23. An electrophotographic apparatus according to claim 20, further comprises:

a cabinet covering the development unit, the gas supply unit, the image transfer unit, the cover and the recovery system, wherein the cabinet has a hollow portion which has a discharge port to discharge the recording medium and a suction port to suck the gas which is supplied to the gas supply unit.

24. An electrophotographic apparatus according to claim 23, wherein:

the hollow portion has two suction ports which are faced each other, and the recording medium is discharged between two suction ports.

25. An electrophotographic apparatus according to claim 20, further comprising:

a squeeze roller squeezing a part of the liquid carrier on the latent image holding member before the liquid carrier is evaporated by the gas.

26. An electrophotographic apparatus according to claim 25, further comprising:

an absorbing roller which absorbs a part of the liquid carrier on the latent image holding member before the liquid carrier is evaporated by the gas.

* * * * *